United States Patent [19]

Wu

[11] 4,007,099

[45] Feb. 8, 1977

[54] CATHODIC PRODUCTION OF MICROPORES IN CHROMIUM

[75] Inventor: Sidney H. L. Wu, Warrensville Heights, Ohio

[73] Assignee: The Harshaw Chemical Company, Cleveland, Ohio

[22] Filed: Oct. 8, 1975

[21] Appl. No.: 620,511

[52] U.S. Cl. ..... 204/140; 204/35 R; 204/41

[51] Int. Cl.[2] ..... C25D 5/48

[58] Field of Search ..... 204/140, 41, 35 R

[56] References Cited

UNITED STATES PATENTS

| | | | |
|---|---|---|---|
| 3,479,162 | 11/1969 | Yanabu et al. | 29/195 |
| 3,574,069 | 4/1971 | Roberts et al. | 204/29 |
| 3,642,587 | 2/1972 | Allen et al. | 204/35 N |
| 3,838,024 | 9/1974 | Austin et al. | 204/41 |

*Primary Examiner*—G. L. Kaplan
*Attorney, Agent, or Firm*—Richard M. Howell

[57] ABSTRACT

A metal base which has a decorative chromium plate layer 0.002 to 0.10 mil thick on a nickel or similar substrate, usually 5 to 100 or more times as thick as the chromium plate layer, is used as a cathode in an electric cell in which the electrolyte solution is an aqueous acidic solution of hexavalent chromium in a combined state with oxygen and oxide ions of sulfur, selenium and/or tellurium, preferably the sulfate ion, preferably together with any of certain catalytic metal ions. When the electrolyte solution is heated to no more than about 195° F. but preferably at least 150° F. and a current in the range of about 0.3 to 4.5 amperes per square foot of chromium plate layer is introduced for 20 seconds to 10 minutes, preferably with a gradual increase in current over the first 3 seconds to 3 minutes, the chromium plate layer becomes thoroughly perforated with micropores, protecting the substrate from severe electrolytic attack and consequently protecting the metal base from any normal corrosion.

10 Claims, No Drawings

CATHODIC PRODUCTION OF MICROPORES IN CHROMIUM

BACKGROUND OF THE INVENTION

This invention relates to metal articles which have decorative chromium plating in layers of the order of 0.002 to 0.10 mil over a metal substrate such as nickel, nickel-iron or cobalt plate with or without other plate layers between the substrate and a metal base which is usually a ferrous metal. The thinness of the chromium layer allows the quality of the substrate surface to affect the total surface appearance. Thus, if the substrate has a bright surface, the chromium-plated substrate will also have a bright surface. If the substrate has a semi-bright or lustrous surface, the chromium-plated substrate will also have a semi-bright or lustrous surface. However, such plating fails to protect the metal base from corrosion which develops at small cracks and/or single pores in the chromium layer and under corrosive conditions reaches the metal base. While thicker layers of chromium plate and/or substrate give better protection to the base, the additional cost is unattractive, the resulting plate is not decorative, and such thicker layers do not guarantee against such cracks because the presence of few corrosion sites in any thickness plate leads to severe attack of the substrate down to the metal base.

The presence of many microcracks and/or micropores in the exposed chromium plate layer apparently creates a stable condition wherein no major deep corrosion of the substrate takes place, thereby protecting the metal base under the substrate from any corrosion whatever. Microcracks have been produced by inducing high stress in the chromium and/or substrate layers whereby the microcrack pattern develops to relieve the resulting strain. Such stress is most commonly produced by including ions such as the selenate or fluosilicate ions in chromium plating baths and ammonium and chloride ions with embrittling agents in nickel plating baths (U.S. Pat. No. 3,563,864). Micropores have been produced mechanically heretofore by incorporating extremely small particles into the substrate surface during electrodeposition of the substrate so that the subsequently electrodeposited chromium forms a porous layer interrupted at the site of each particle in the substrate surface. A similar mechanical approach has involved lightly impinging particles of sand or the like on the chromium surface after its electrodeposition to produce micropores.

The subject invention is directed to a cathodic treatment of chromium plated substrates to produce micropores in the chromium plate layer. A review of the prior art has failed to reveal any method of developing by any electric treatment micropores in a chromium plate layer after electrodeposition of the chromium is complete.

U.S. Pat. No. 2,746,915 describes a system for the electrodeposition on a plated surface of a chromium compound coating which is anodic to steel. The coating is applied by placing the article to be treated in a bath, preferably acidic, containing hexavalent chromium and electrolyzing the bath with the article as the cathode. The outer plate layer on the article prior to treatment was, for example, a chromium plate layer about 0.00001 inch thick or about 0.01 mil. The specific treatment described made use of a bath having a hexavalent chromium concentration of 50 grams per liter and a pH of 4.5, a current density of 3 to 4 amperes per square foot, a temperature of 200° F. and a treatment time of 1 to 2 minutes. Current densities of 0.1 to 15 amperes per square foot are mentioned as are a pH as low as 2.5 and hexavalent chromium concentrations of from 1 to 200 grams per liter. The only acid disclosed is chromic acid. There is no mention of micropores or their formation.

U.S. Pat. No. 3,816,082 describes a system of electrochemically treating an article covered with a chromium plate of 0.1 to 0.5 microinch or 0.0001 to 0.0005 mil as a cathode in an aqueous electrolyte containing a water soluble hexavalent chromium compound, preferably 20 to 50 grams per liter of chromic acid, to deposit a metallic chromium and chromium oxide containing film thereon. The electrolyte can also contain a sulfate ion catalyst in an amount of 0.05 to 0.2 gram per liter. The treatment makes use of a temperature of 90° to 150° F., a current density of 25 to 400 amperes per square foot and a treatment time of 0.3 to 0.5 second. However, the chromium must be plated on a zinc substrate. There is no mention of micropores or their formation.

In an article entitled "Process for Coating Tin-Free Steel with Layers of Metallic Chromium and Chromium Oxide," Fukuda et al., Journal of the Electrochemical Society, March, 1969, various plating solutions of chromic acid and sulfate ion are shown for the cathodic treatment of steel. While chromic acid has been in common use for metal finishing, no one has heretofore used chromic acid in any method of making micropores in chromium.

In order for microcracks and/or micropores in chromium plate on a suitable substrate to produce evenly a significant improvement in corrosion protection of the base it is necessary that such microcracks and micropores be distributed over the entire chromium plate surface. Otherwise, non- or lightly-cracked and/or non- or lightly-porous areas receive severe corrosion. For example, in the electrodeposition of microcracked chromium from a fluosilicate-containing bath on a suitable substrate it has been found that the desired microcracks do not tend to form in low current density areas apparently because the thickness of chromium is insufficient, and therefore severe corrosion will occur in these areas. This tendency is offset substantially by the cathodic treatment of this invention which induces the formation of micropores uniformly in the chromium layer including such low current density plating areas.

SUMMARY OF THE INVENTION

This invention comprises a method for the production of micropores in a chromium plate layer from about 0.002 to 0.10 mil thick on a substrate layer, said method comprising 1. immersing said chromium plate layer as a cathode in an electric cell with a non-reactive anode, the electrolyte solution in said cell being an acidic aqueous solution having a pH at least high enough to avoid stripping said chromium plate from said substrate but no greater than 6, preferably no greater than 2.5, and containing from 0.5 to 390 grams per liter of hexavalent chromium in a combined state with oxygen and from about 1.5 to about 240, preferably about 2 to 30, gram-millimoles per gram of said chromium of oxygen-containing ions of an element selected from sulfur, selenium and tellurium, preferably the sulfate ion, said ions preferably being present in amount no greater than about 10 times the square of the pH when such pH is greater than 2.5, said electrolyte solution being maintained in the temperature range of about 68° to about 195° F., preferably about 130° to 186° F., more preferably at least about 150° F., and 2. introducing current into said cell at the rate of at least about 0.3 ampere, preferably about 0.7 to 4.5 amperes, per square foot of said chromium plate layer exposed to said electrolyte solution for a time period of at least 3 seconds, preferably about 20 seconds to 10 minutes, whereby in said chromium plate layer there are produced micropores each having a dimension of from about 0.1 to a few microns, said micropores being produced in a density of about 50,000 to 3,000,000 or more micropores per square inch as determined by the Dubpernell Test.

The method of this invention is preferably catalyzed by the presence in said electrolyte solution of at least one metal ion of the group copper, silver, gold, platinum and palladium, mixtures thereof and complex ions thereof, said ions being present in an amount of at least 0.02 gram-millimoles per liter of electrolyte solution. It is also desirable in step (2) to raise the current in said cell from 0 to the desired level over a period of time such as 3 seconds to 3 minutes.

DESCRIPTION OF THE PREFERRED EMBODIMENTS

In the method of this invention the chromium plate layers to be affected range in thickness from about 0.002 to 0.10 mil. Such thin layers generally assume the appearance of the substrate surface. The quality control of such plating is within the skill of the art. Similarly, the choice of metal base and substrate layer or layers is within the skill of the art. The substrate layer must be at least as thick as the chromium plate layer and usually has a thickness in the range of 5 to 100 times the thickness of the chromium plate layer but need not be limited to such thickness. A nickel or nickel-iron substrate is preferred. The commonest metal base is steel or other ferrous metal.

For the purposes of this invention the chromium plated article is used as a cathode in an electric cell. The anode can be any suitable material, stainless steel being highly satisfactory.

The composition of the aqueous electrolyte solution used in the method of this invention is critical. First, the pH of the electrolyte solution must be no higher than about 6.0, preferably no higher than about 2.5. If the pH is too low, chromium plate stripping can take place, but this is the only limiting factor on the minimum pH so far as the method of this invention is concerned. If the pH is too high, there is no significant micropore formation.

Second, the electrolyte solution must contain dissolved therein hexavalent chromium in a combined state with oxygen. This is usually the chromate or dichromate ion and is added as chromium trioxide, commonly known as chromic acid, or any chromate or dichromate salt the cation of which will not adversely affect the operation. The hexavalent chromium is present in an amount from about 0.5 to 390 grams per liter of the electrolyte solution equal to about 0.01 to 7.5 gram-moles of hexavalent chromium per liter of electrolyte solution.

Third, the electrolyte solution must contain ions of one or more of sulfur, selenium and/or tellerium in a combined form with oxygen, the preferred ions being sulfate ions. The ion, particularly the sulfate ion, is usually introduced as the corresponding acid, such as sulfuric acid, but can be introduced in some other soluble form such as the salt, such as sodium sulfate. The subject ions can be present in an amount equivalent to from about 1.5 to about 240 gram-millimoles per gram of said hexavalent chromium or 0.075 to 12 gram-moles of said ions per gram-mole of said hexavalent chromium but is preferably present in an amount equivalent to from about 2.0 to about 30 gram-millimoles per gram of chromium or 0.1 to 1.5 gram-moles of said ions per gram-mole of chromium. There appears to be a relationship between the acidity of the electrolyte and the amount of said ions which can be present such that between pH levels of about 2.5 and 6 the amount of said ions measured in gram-millimoles per gram of hexavalent chromium in said electrolyte solution is no more than about 10 times the square of the pH numbers.

The temperature of the electrolyte solution appears to have a strong effect on the method of this invention. In general, the higher the treatment temperature, the shorter the required treatment time but also the fewer the number of micropores formed. No simple correlation has been discovered. As a practical matter the electrolyte solution should be at least about room temperature (68° F.). It has been found that the temperature of the electrolyte solution can be as high as 195° F., but more reproducible results are achieved when the electrolyte solution is in the range of about 130° to 186° F. with optimum results at 150° F. and above.

In the method of this invention the temperature, current density and treatment time have a combination effect in the production of micropores. Current density must be at least 0.3 ampere per square foot of chromium plate layer to be treated and, as a practical matter, should not be higher than about 4.5 amperes per square foot although higher current densities can probably be used depending on the desired result and the treatment time and temperature. The treatment time must be at least 3 seconds, preferably at least 20 seconds, and, as a practical matter, should be no longer than 10 minutes, preferably no longer than about 5 minutes. At a given temperature the lower the current density, the fewer the micropores produced, and the longer the time, the deeper the etch extending even into the substrate. Thus, for the purposes of this invention it is generally preferred to use higher current densities and shorter times within the defined limits.

It is preferable that the electrolyte solution contain as a catalyst at least one metal ion of the group copper, silver, gold, platinum and palladium although mixtures and complex ions thereof can also be used. Such ions can be introduced to the electrolyte solution as water-soluble compounds like palladium chloride, chlorauric acid, silver nitrate, cupric chloride or chloroplatinic acid or simply by dipping a metal such as pure copper or brass into the electrolyte solution long enough for some metal to dissolve. Any catalyst is better than no catalyst, but preferably there should be at least about 0.02 gram-millimole of metal per liter of electrolyte solution. As a practical matter no more than about 0.5 gram-millimole of metal catalyst per liter of electrolyte solution need be present.

It has been found particularly advantageous to use a current sweep in the method of this invention, that is, to increase the cathodic current from 0 to the desired level over a period of time ranging from about 3 seconds to as much as 3 minutes or more. This technique is particularly useful in producing broader more uniform micropore coverage in the chromium plate layer being treated although pore density is less in most cases than would be achieved without current sweep. This is particularly useful when treating chromium plate layers plated at high current densities. Current sweep also improves micropore production in thin micro-cracked chromium plate layers which, because of the thinness, have not developed enough microcracks for corrosion protection. When the treatment temperature is high (180° F. or above), optimum uniformity of micropore density is achieved. As the treatment temperature is reduced to 170° F. or 160° F., uniformity of micropore density can be achieved by using the above-described current sweep for periods of 30 seconds or less. As the treatment temperature is further reduced, the duration of the current sweep must be substantially increased (2 minutes or more) to accomplish the same micropore density uniformity. While the treatment is still perfectly operable, the substantial increase in treatment time is commercially undesirable.

One test used for the evaluation of this invention was the Dubpernell Test, (1970) BS 1224: Appendix E, E.2 Determination of Cracks and Pores in Chromium Coatings. This test basically involves briefly plating copper on a substrate covered with a micro-discontinuous chromium plate layer including either or both microcracks and micropores. Copper plates out on the substrate making possible visual count of the micropores or microcracks in the chromium plate layer. The method of this invention can produce from about 50,000 to 3,000,000 or more micropores per square inch. Because of the microporosity in the chromium plate layer, good protection of the metal base against corrosion is obtained by minimizing the severity of corrosion of the substrate. At least within this range it appears that the greater the micropore density, the better the protection against corrosion. In determining the micropore density it must be noted that such density varies with the type of plated surface, particularly the configuration of such surface, and with the current density during treatment at each part of such surface. At any given single treatment current density the resulting micropore density will differ for flat surfaces, curved surfaces, sharply-bent surfaces, edges and even near the edges of such surfaces. These differences are further confused by the variation of current density over a surface being treated.

The results of this invention were also evaluated by a combination test of treated surfaces including 16 hours of ASTM B 368-68 (CASS) followed by 20 hours of ASTM B 380-65 (Corrodkote) followed by another 16 hours of ASTM B 368-68. The CASS test in brief consists of placing a test specimen in a large enclosure in which is continually circulated a mist of an aqueous solution containing sodium chloride, cupric chloride and acetic acid. The Corrodkote test in brief consists of coating a test specimen with a slurry of kaolin and a solution containing cupric nitrate, ferric chloride and ammonium chloride and placing the coated test specimen into a large enclosure of controlled humidity.

The following examples are intended to illustrate the best presently-known modes of practicing the subject invention and are not intended to limit this invention the scope of which is properly delineated in the claims. Unless otherwise stated, all quantitative measurements are by weight.

EXAMPLE I

A 6 × 1½ × 1/32 inch steel panel was degreased, cleaned and plated with a cyanide copper strike followed by a 0.5 mil layer of bright acid copper and a 0.6 mil layer of bright nickel. This panel was then plated in a standard chromium bath to a chromium thickness of 0.012 mil on one surface. The chromium plated panel was employed as a cathode in an electric cell by 5/6 immersion with a stainless steel anode in an aqueous electrolyte solution having a pH of 1.5 and containing 15 gm./l. $CrO_3$ (equivalent to 7.8 gm./l. of hexavalent Cr) and 3 ml./l. concentrated sulfuric acid (equivalent to 6.9 gram-millimoles of sulfate ion per gram of hexavalent chromium) at 166° F. with a current of 0.15 ampere (equivalent to about 1.4 amperes per square foot of exposed chromium plate layer) for 2 minutes. This panel was then subjected to accelerated corrosion tests together with a control panel which was plated the same way but without the cathodic treatment. After a cycle of 16 hours CASS, 20 hours Corrodkote and 16 hours CASS the test surface of the cathodically treated panel was free of rust spots while the test surface of the control panel was severely rusted.

A Dubpernell Test of a separate panel plated and cathodically treated as above revealed the presence of micropores in the test chromium layer with a pore density greater than 20,000,000 pores per square inch of exposed surface.

EXAMPLE II

A steel panel like that employed in EXAMPLE I but with a chromium layer of 0.01 mil thickness was employed as a cathode in an electric cell by 5/6 immersion with a stainless steel anode in an aqueous electrolyte solution having a pH of 1.8 and containing 3.9 gm./l. $CrO_3$ (equivalent to 2.0 gm./l. of hexavalent Cr) and 1.4 ml./l. concentrated sulfuric acid (equivalent to 2.8 gram-millimoles of sulfate ion per gram of hexavalent chromium) at 161° F. with a current of 0.11 ampere (equivalent to about 1 ampere per square foot of exposed chromium plate layer) for 3 minutes. An electronmicrograph taken of the test surface showed millions of micropores per square inch with pore sizes ranging from about 0.1 to 1 micron in diameter.

EXAMPLE III

Brass panels prepared like that employed in EXAMPLE I but each being 4 × 2½ × 1/32 inch and having a chromium plate layer of 0.006 mil thickness were employed as cathodes in Hull cells by 80 percent immersion with stainless steel anodes in a series of aqueous electrolyte solutions each containing 15 gm./l. $CrO_3$ (7/8 gm./l. of hexavalent Cr) and 40 ml./l. concentrated sulfuric acid (92.4 gram-millimoles of sulfate ion per gram of hexavalent chromium) and various amounts of sodium hydroxide to give pH values of 0.38, 1.10, 2.18, 3.00, 4.90 and 6.92, operating conditions being room temperature (about 68° F.), 0.10 ampere (calculated to be an average of about 1.8 amperes per square foot of exposed chromium plate layer) and 6 minutes. Under these treatment conditions only the test surfaces from the solutions having pH values of 3.00 and 4.90 showed the desired microporosity by the Dubpernell Test.

EXAMPLE IV

Another buffed brass panel of the same size and preparation as the chromium plated panels of EXAMPLE III was similarly cathodically treated in an aqueous electrolyte solution having a pH of 1.9 and containing 24 gm./l. $Na_2Cr_2O_7.2H_2O$ (equivalent to 8.4 gm./l. of hexavalent chromium) and 2 ml./l. concentrated sulfuric acid (4.3 gram-millimoles of sulfate ion per gram of hexavalent chromium) at 159° F. with a current of 0.15 ampere (calculated to be an average of about 0.26 ampere per square foot of exposed chromium plate layer) for 4 minutes. A Dubpernell Test of this panel showed the presence of micropores with a pore density of 22,000,000 per square inch of exposed chromium plate layer surface.

EXAMPLE V

Two 4 × ½ × 1/32 inch steel panels were each plated with a 0.25 mil layer of bright nickel and a 0.024 mil layer of regular chromium.

One panel was cathodically treated by 60 percent immersion in an aqueous electrolyte solution having a pH of 1.55 and containing 12 gm./l. $CrO_3$ (about 6.2 gm./l. of hexavalent Cr) and 3 ml./l. concentrated sulfuric acid (8.8 gram-millimoles of sulfate ion per gram of hexavalent chromium) at 150° F. with a current of 0.03 ampere (about 1.7 amperes per square foot of exposed chromium plate layer) for 5 minutes. This treated panel was found by the Dubpernell Test to have about 400,000 micropores per square inch of exposed chromium plate surface.

The second panel was cathodically treated in an identical manner except that the electrolyte solution also contained 0.1 gram-millimoles/l. of palladium chloride ($PdCl_2$). This treated panel was found by the Dubpernell Test to have over 20,000,000 micropores per square inch of exposed chromium plate surface.

EXAMPLE VI

A 6 × 1½ × 1/32 inch brass panel was shaped to have a sharp 90° bend one inch from one end followed by a gradual 90° curve of approximately 2 inch radius and was then plated with bright nickel and regular chromium. The one inch tab had a chromium plate layer thickness in the range of 0.014 to 0.018 mil while the remaining five inches of panel had a chromium plate layer thickness in the range of 0.002 to 0.008 mil. This panel was employed as a cathode in an electric cell by 80 percent immersion with a stainless steel anode in an aqueous electrolyte solution having a pH of 1.55 and containing 12 gm./l. $CrO_3$ (about 6.2 gm./l. of hexavalent Cr), 3 ml./l. concentrated sulfuric acid (8.8 gram-millimoles of sulfate ion per gram of hexavalent chromium) and 0.06 gram-millimoles/l. of palladium chloride at 174° F. with a current of 0.10 ampere (about 1.0 ampere average per square foot of exposed chromium plate layer) for 50 seconds. This treated panel was found by the Dubpernell Test to have about 7,500,000 micropores per square inch of exposed chromium plate surface over all areas except part of the one inch tab and on the sharp 90° bend where the micropore density was substantially less.

A second panel similarly shaped and plated was similarly cathodically treated except that at the start of the treatment the current was raised from 0 to 0.10 ampere over a period of 20 seconds before a 40 second straight current treatment. This treated panel was found by the Dubpernell Test to be covered uniformly on all surfaces by 600,000 micropores per square inch.

EXAMPLE VII

A 6 × 1½ × 1/32 inch steel panel shaped to include a gradual 180° curve of about 1 inch radius, each end of the curve being terminated by a sharp 90° bend, and plated with a cyanide copper strike followed by 0.75 mil layer of bright acid copper and a 0.5 mil layer of bright nickel and from 0.002 to 0.007 mil layer of regular chromium was employed as a cathode in an electric cell by 80 percent immersion with a stainless steel anode in an aqueous electrolyte solution having a pH of 1.55 and containing 12 gm./l. $CrO_3$ (about 6.2 gm./l. of hexavalent Cr) and 3 ml./l. concentrated sulfuric acid (8.8 gram-millimoles of sulfate ion per gram of hexavalent chromium) at 177° F. gradually increasing the current from 0 to 0.10 ampere over a period of 9 seconds followed by 31 seconds at 0.10 ampere (about 1 ampere per square foot of exposed chromium plate surface).

This treated panel was subjected to the accelerated corrosion tests of EXAMPLE I together with an identical panel except without cathodic treatment. After the tests the treated panel was found to have no rust spots while the control panel was severely rusted.

EXAMPLE VIII

A 6 × 4 × 1/32 inch steel panel plated with a 0.7 mil layer of semi-bright nickel, 0.3 mil layer of bright nickel and a 0.015 mil layer of regular chromium was employed as a cathode in an electric cell by 84 percent immersion with two stainless steel anodes in an aqueous electrolyte solution having a pH of 1.25 and containing 36 gm./l. $CrO_3$ (about 18.7 gm./l. of hexavalent Cr), 6 ml./l. concentrated sulfuric acid (5.8 gram-millimoles of sulfate ion per gram of hexavalent chromium) and 0.06 gm.-millimoles/l. of palladium chloride at 162° F. gradually increasing the current from 0 to 0.9 ampere over a period of 10 seconds followed by 90 seconds at 0.9 ampere (about 3.2 amperes per square foot of exposed chromium plate surface).

This treated panel was subjected to 8 cycles of the 16 hour CASS test with an identical panel except without cathodic treatment. After this accelerated corrosion test the surface of the treated panel showed no rust spots while the surface of the control panel was severely rusted.

EXAMPLE IX

Another 6 × 4 × 1/32 inch steel panel plated and cathodically treated in the same way as the panel of EXAMPLE VIII was subjected with another control panel to 9 cycles of the 20 hour Corrodkote Test. After this accelerated corrosion test the surface of the cathodically treated panel showed no rust spots while the surface of the untreated control panel was severely rusted.

EXAMPLE X

Two 6 × 1½ × 1/32 inch steel panels plated with a cyanide copper strike, a 0.75 mil layer of bright acid copper and a 0.5 mil layer of bright nickel were each plated in a chromium bath containing hexafluorosilicate ions to produce a microcracked chromium layer 0.01 mil thick on one major surface (front) and a microcracked chromium layer about 0.0025 mil thick on the opposite major surface (back). Because of the thinness of the microcracked chromium layers, few cracks were developed in said layers.

These panels were employed as cathodes in separate electric cells by 80 percent immersion with a stainless steel anode in an aqueous electrolyte solution having a pH of 1.25 and containing 36 gm./l. $CrO_3$ and 6 ml./l. concentrated sulfuric acid at 162° F. gradually increasing the current from 0 to 0.3 ampere over a period of 15 seconds followed by 85 seconds at 0.3 ampere (about 3 amperes per square foot of exposed chromium plate surface).

The front surface of one cathodically treated panel and the back surface of the other cathodically treated panel were subjected to the accelerated corrosion test of EXAMPLE I together with identical but untreated surfaces. After the test the treated surfaces showed no rust spots while the untreated control surfaces were severely rusted.

I claim:

1. A method for the production of micropores in a chromium plate layer from about 0.002 to 0.10 mil thick on a substrate layer, said method comprising 1. immersing said chromium plate layer as a cathode in an electric cell with a non-reactive anode, the electrolyte solution in said cell being an acidic aqueous solution having a pH at least high enough to avoid stripping said chromium plate from said substrate but no greater than 6.0 and containing from 0.5 to 390 grams per liter of hexavalent chromium in a combined state with oxygen and from about 1.5 to about 240 gram-millimoles per gram of hexavalent chromium of oxygen-containing ions of an element selected from the group consisting of sulfur, selenium and tellurium, said electrolyte being maintained in the temperature range of 68° to 195° F.; and
2. introducing current into said cell at the rate of from at least about 0.3 to no greater than 4.5 amperes per square foot of said chromium plate layer exposed to said electrolyte solution for a time period of at least 3 seconds, whereby in said chromium plate layer there are produced micropores in a density of at least 50,000 micropores per square inch as determined by the Dubpernell Test.

2. The method in accordance with claim 1 wherein said electrolyte solution also contains at least about 0.02 gram-millimoles per liter of electrolyte solution of at least one metal ion selected from the group consisting of copper, silver, gold, platinum, palladium, mixtures and complex ions thereof.

3. The method in accordance with claim 1 wherein in Step (2) the current is increased from 0 to the desired level over a period of at least 3 seconds but no longer than about 3 minutes.

4. The method in accordance with claim 1 wherein the temperature of said electrolyte solution is in the range of 130° to 186° F.

5. The method in accordance with Claim 4 wherein said oxygen-containing ions are present in an amount of from about 2.0 to about 30 gram-millimoles of said ions per gram of hexavalent chromium but in an amount, measured as gram-millimoles per gram of hexavalent chromium, no greater than about 10 times the square of the pH when such pH is greater than 2.5.

6. The method in accordance with claim 5 wherein in Step (2) the total said time period is 20 seconds to 10 minutes.

7. The method in accordance with claim 6 wherein the temperature of the electrolyte solution is at least 150° F.

8. The method in accordance with claim 7 wherein the pH of said electrolyte solution is no greater than 2.5, said oxygen-containing ions are sulfate ions and the total said time period is no greater than 5 minutes.

9. The method in accordance with claim 8 wherein in Step (2) the current is increased from 0 to the desired level over a period of at least 3 seconds but no longer than about 3 minutes.

10. The method in accordance with claim 8 wherein said electrolyte solution also contains from about 0.02 to about 0.5 gram-millimoles per liter of electrolyte solution of at least one metal ion selected from the group consisting of copper, silver, gold, platinum, palladium, mixtures and complex ions thereof.

* * * * *